US006874264B1

(12) United States Patent
Coito

(10) Patent No.: US 6,874,264 B1
(45) Date of Patent: Apr. 5, 2005

(54) FRAME ASSEMBLY FOR MOUNTING IN A ROOM CORNER

(76) Inventor: Steven P. Coito, 2307 Apex Ct., Martinez, CA (US) 94553

( * ) Notice: Subject to any disclaimer, the term of this patent is extended or adjusted under 35 U.S.C. 154(b) by 0 days.

(21) Appl. No.: 10/374,122

(22) Filed: Feb. 25, 2003

(51) Int. Cl.[7] ..... A47G 1/16

(52) U.S. Cl. ..... 40/757; 40/617

(58) Field of Search ..... 40/757, 758, 617, 40/759, 761; 248/489, 491, 494, 495

(56) References Cited

U.S. PATENT DOCUMENTS

| | | | | |
|---|---|---|---|---|
| 259,751 A | | 6/1882 | Downes et al. | |
| 449,496 A | * | 3/1891 | Rulon | 248/496 |
| 882,339 A | * | 3/1908 | Olson | 248/494 |
| 2,991,577 A | | 7/1961 | Bellocchio | |
| 4,055,319 A | * | 10/1977 | Pendock | 248/491 |
| 4,542,876 A | * | 9/1985 | Hogg | 248/491 |
| 5,373,654 A | | 12/1994 | Whalen | |

* cited by examiner

*Primary Examiner*—Brian K. Green
(74) *Attorney, Agent, or Firm*—Thomas R. Lampe

(57) ABSTRACT

A frame assembly for mounting in an upper corner of a room includes a triangular-shaped frame and an elongated, flexible biasing member attaching the frame to the corner. A receptacle is attached to the biasing member for receiving the lower end of the frame.

3 Claims, 2 Drawing Sheets

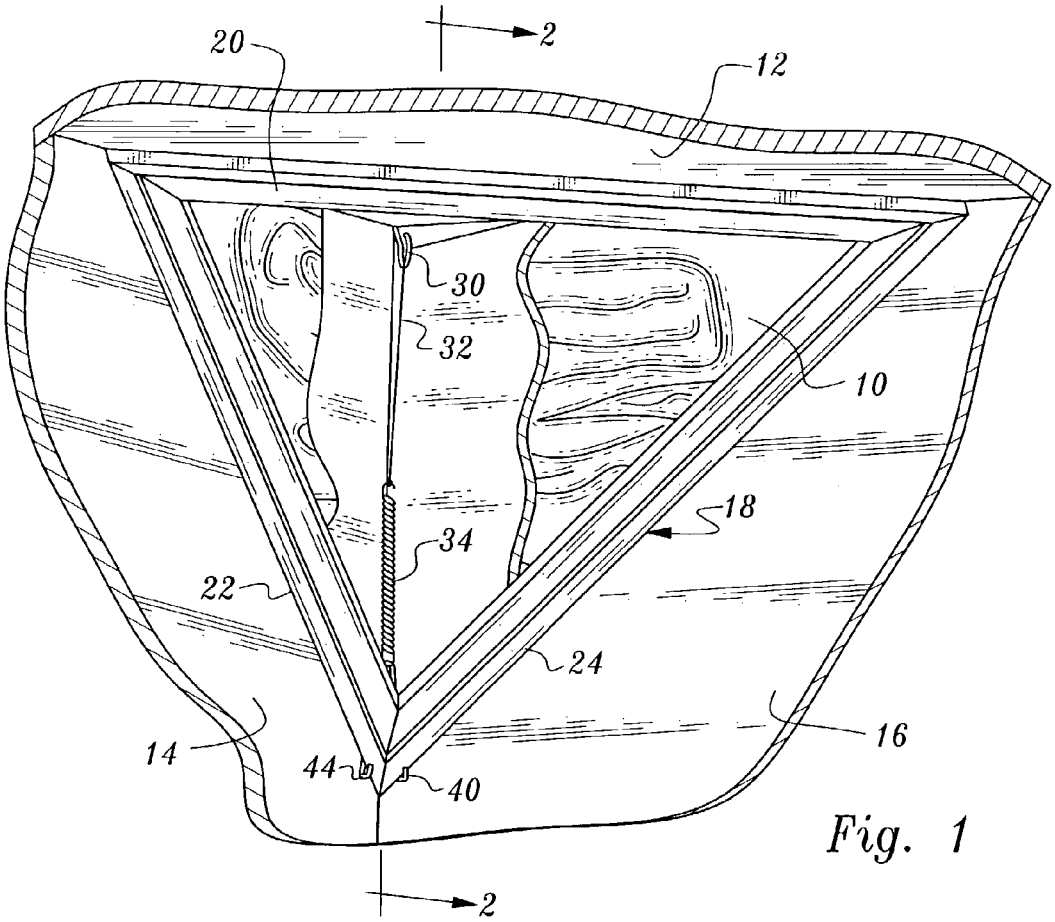
Fig. 1
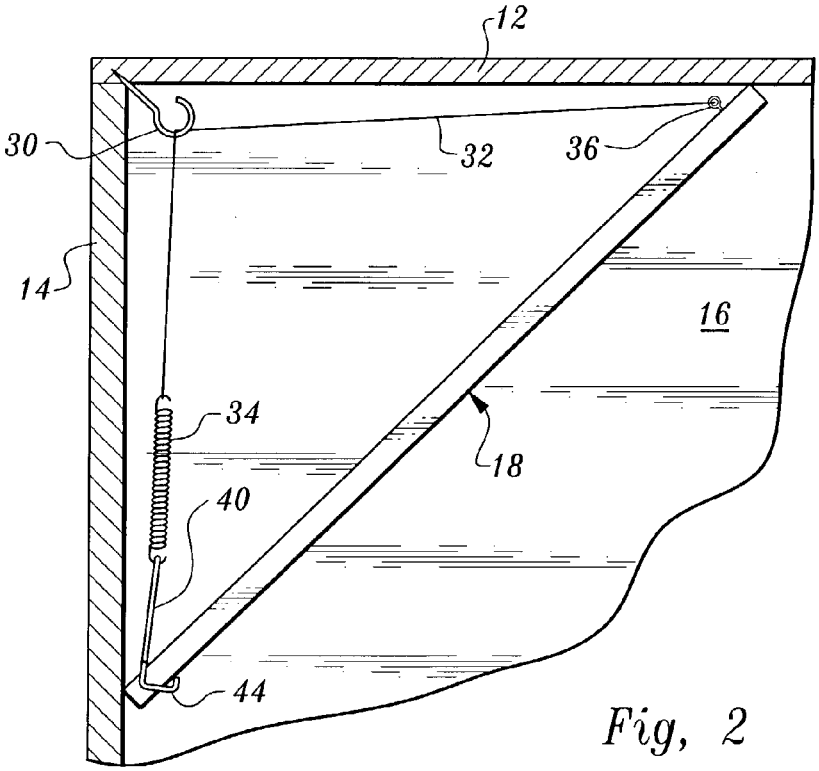
Fig, 2

FRAME ASSEMBLY FOR MOUNTING IN A ROOM CORNER

TECHNICAL FIELD

This invention relates to a frame assembly for holding an object, such as a picture or signage, and mounting the object in an upper corner of a room.

BACKGROUND OF THE INVENTION

A number of arrangements have been devised for mounting picture frames in room corners. The following United States patents disclose arrangements of this type: U.S. Pat. No. 259,751, issued Jun. 20, 1882, U.S. Pat. No. 2,991,577, issued Jul. 11, 1961, and U.S. Pat. No. 5,373,654, issued Dec. 20, 1994.

U.S. Pat. No. 2,991,557 is worthy of comment, the patent disclosing a triangular-shaped frame mounted at an upper corner of a room where the ceiling and two walls converge. The frame is held in place by a spring-biased cord extending between a mounting hook and two locations at the back of the frame. More particularly, the ends of the cord are hooked to two eyelets, one disposed in the back of the top of the frame and the other in the back of the frame bottom. The eyelets project from the frame back and are hidden from view. This arrangement makes it difficult to mount the frame and also to remove it. The bottom of the frame must be manually pulled a considerable distance away from the side walls to allow manual access to the lower end of the mounting cord so that it can be selectively engaged with or disengaged from the eyelet at the bottom of the frame. This is not only awkward but can result in breakage of the cord and/or spring and wall scuffing during either installation or removal of the frame.

DISCLOSURE OF INVENTION

The present invention relates to an improved frame assembly for mounting in an upper corner of a room formed by a room ceiling and two interconnected room walls extending downwardly from the room ceiling.

The invention is characterized by its ability to be readily installed or deinstalled.

The frame assembly includes a frame having a triangular-shaped outer peripheral surface and including a double-ended upper frame portion and two side frame portions extending downwardly from the ends of the upper frame portion. The two side frame portions converge at a location below the level of the frame portion.

The assembly also includes a fastener member attached to the upper corner.

An elongated, flexible biasing member is connected to the upper frame portion and the fastener member and extends downwardly from the fastener member toward the location of convergence of the two side frame portions.

A receptacle is attached to the biasing member and spaced from both the upper frame portion and the fastener member. The receptacle engages and receives the two side frame portions at the location of convergence of the two side frame portions.

Other features, advantages and objects of the present invention will become apparent with reference to the following description and accompanying drawings.

BRIEF DESCRIPTION OF DRAWINGS

FIG. 1 is a frontal, perspective view illustrating the frame assembly of the present invention mounted in an upper corner of a room, a portion of the picture within the frame being broken away to show structural details behind the frame;

FIG. 2 is a cross-sectional view taken along the line 2—2 of FIG. 1;

MODES FOR CARRYING OUT THE INVENTION

Figure 3:
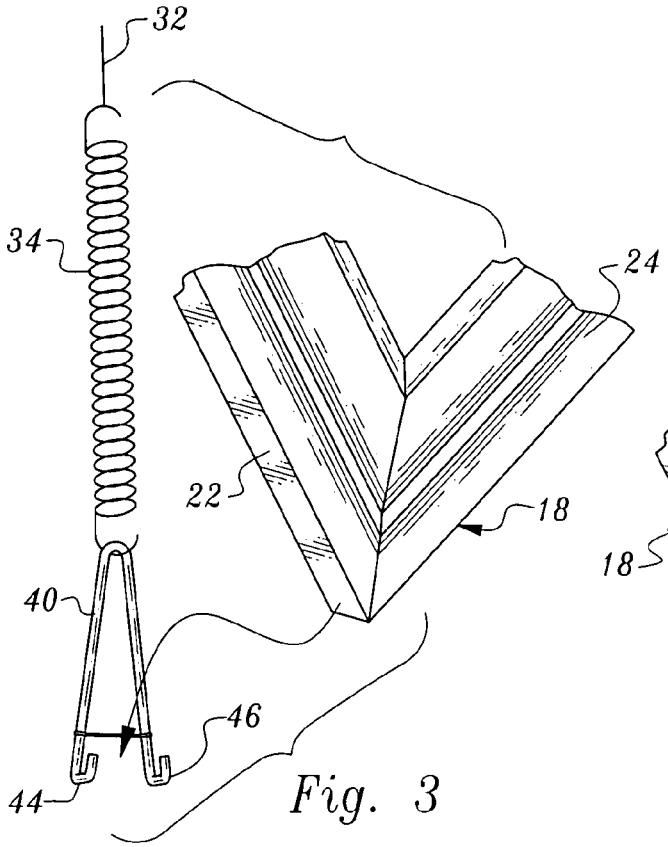
FIG. 3 is a perspective view illustrating the lower end of the frame of the assembly prior to positioning in a receptacle associated with a biasing member employed in the assembly.

Referring now to FIGS. 1–4, an embodiment of the frame assembly invention is illustrated. The frame assembly is for mounting objects, such as picture 10, in an upper corner of a room formed by room ceiling 12 and two interconnected room walls 14, 16 extending downwardly from the room ceiling.

The frame assembly includes a frame 18 having a triangular-shaped outer peripheral surface. The frame includes a double-ended upper frame portion 20 and two side frame portions 22, 24 extending downwardly from the ends of the upper frame portion and converging at a location below the level of the upper frame portion.

Disposed behind the frame and attached to the upper room corner is a fastener member in the form of a hook 30.

An elongated, flexible biasing member including a cord 32 and a coil tension spring portion 34 is connected to the upper frame portion 20 by an eyelet screw 36. From eyelet screw 36 the cord extends into engagement with hook 30 and then downwardly, as shown in FIGS. 1 and 2 toward the location of convergence of side frame portions 22, 24.

A receptacle 40 is connected to spring 34 and depends therefrom. The receptacle engages and receives the two side frame portions 22, 24 at the location of convergence of the two side frame portions.

The illustrated receptacle 40 is in the form of an open framework formed of bent metal or the like which includes two spaced frame retention hooks 44, 46. Frame retention hook 44 engages and receives side frame portion 22 and frame retention hook 46 engages and receives side frame portion 24. With regard to this embodiment, as shown in FIGS. 1 and 2, the frame retention hooks 44,46 simultaneously engage the front frame surface, the back frame surface, and the outer peripheral frame surface.

Figure 4:
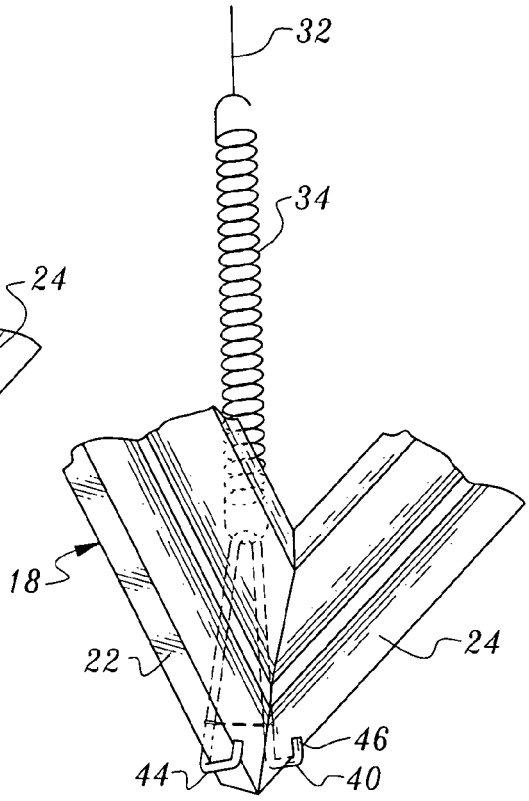
FIG. 4 is a perspective view illustrating the lower end of the frame positioned in and retained by the receptacle.

Installation of the frame in the receptacle 40 is readily accomplished, the user simply manually grasping the outer surface of the receptacle, pulling it to extend the spring 34 and positioning the lower end of the frame in the receptacle as shown in FIG. 4. Once released, the spring and cord exert inwardly and upwardly directed pulling forces on the receptacle and thus on the lower end of the frame to maintain the frame in the position illustrated in FIGS. 1 and 2. This approach lessens the likelihood of wall scuffing.

Figure 5:
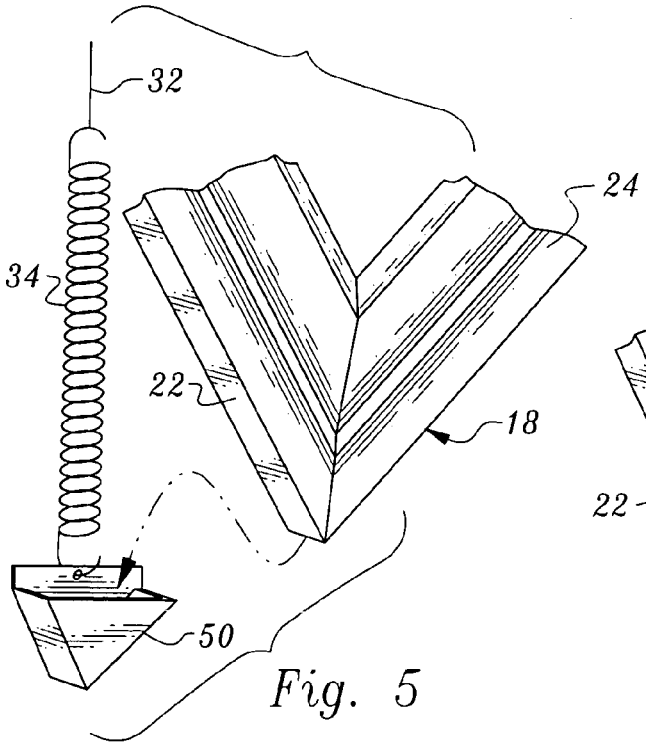
FIG. 5 is a view similar to FIG. 3, but illustrating an alternative embodiment of receptacle.
Figure 6:
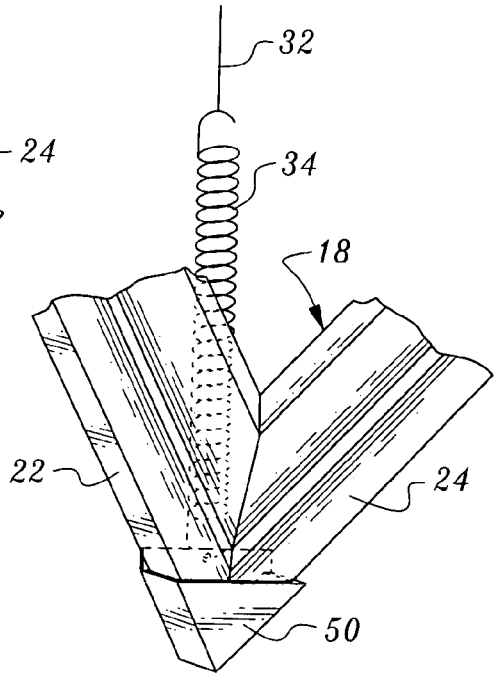
FIG. 6 is a view similar to FIG. 4, but illustrating the alternative embodiment of the receptacle.

FIGS. 5 and 6 illustrate an alternative form of receptacle, receptacle 50. Receptacle 50 comprises a cup, open at the top thereof and having an inner configuration corresponding to the configuration of the bottom of the frame. The receptacle or cup 50 receives the two side frame portions 22, 24 at the location of convergence of the two side frame portions to maintain proper positioning of the frame after installation. With regard to this embodiment, as shown in FIGS. 5 and 6, the receptacle 50 simultaneously engages the front frame surface, the back frame surface, and the outer peripheral frame surface. Other than the receptacle, the frame assembly illustrated in FIGS. 5 and 6 is the same as that shown in FIGS. 1–4.

It will be noted that frame 18 defines a space behind the picture or other object held thereby. This space may be utilized, for example, to accommodate surveillance cameras, motion detectors or the like. Other uses of the frame assembly are also possible. For example, the frame may hold a grill or speaker cloth of a loud speaker positioned in the space between the frame and the room ceiling and side walls.

The invention claimed is:

1. A frame assembly for mounting in an upper corner of a room formed by a room ceiling and two interconnected room walls extending downwardly from the room ceiling, said frame assembly comprising, in combination:

a frame having a front frame surface, a back frame surface and a triangular-shaped outer peripheral frame surface disposed between and interconnecting said front frame surface and said back frame surface, said frame including a double-ended upper frame portion and two side frame portions extending downwardly from the ends of the upper frame portion and converging at a location below the level of said upper frame portion;

a fastener member attached to said upper corner;

an elongated, flexible biasing member connected to said upper frame portion and said fastener member, said elongated, flexible biasing member extending downwardly from said fastener member toward the location of convergence of said two side frame portions; and a receptacle attached to said elongated, flexible biasing member and spaced from both said upper frame portion and said fastener member, said receptacle being of unitary construction and receiving said two side frame portions at the location of convergence of said two side frame portions, said receptacle simultaneously engaging the front frame surface, the back frame surface and the outer peripheral frame surface at opposed locations on said two side frame portions to support and stabilize said frame against movement, said elongated, flexible biasing member including a resilient portion continuously biasing said receptacle toward said frame and said receptacle including a manually graspable outer surface allowing an individual to manually pull the receptacle away from the frame against the bias exerted by said resilient portion.

2. The frame assembly according to claim 1 wherein said receptacle comprises a cup receiving said two side frame portions at the location of convergence of the two side frame portions, said cup having a front cup wall engaging said front frame surface, a rear cup wall engaging said back frame surface and two angularly disposed side cup walls engaging said outer peripheral frame surface.

3. The frame assembly according to claim 1 wherein said receptacle comprises an open framework receiving and holding said two side frame portions at the location of convergence of the two side frame portions, said open framework including two spaced frame retention hooks, one of said frame retention hooks engaging and receiving one of said side frame portions and the other of said frame retention hooks engaging and receiving the other of said side frame portions, said frame retention hooks engaging the front frame surface, the back frame surface and the outer peripheral frame surface at said opposed locations on said two side frame portions.

* * * * *